US006892934B2

(12) United States Patent
Avant

(10) Patent No.: US 6,892,934 B2
(45) Date of Patent: May 17, 2005

(54) HANDLING POTENTIALLY CONTAMINATED MAIL

(75) Inventor: Oscar Lee Avant, Silver Spring, MD (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 10/291,887

(22) Filed: Nov. 8, 2002

(65) Prior Publication Data

US 2003/0127505 A1 Jul. 10, 2003

Related U.S. Application Data

(60) Provisional application No. 60/337,014, filed on Nov. 8, 2001.

(51) Int. Cl.[7] ..... B65D 91/00

(52) U.S. Cl. ..... 232/30; 232/43.2

(58) Field of Search ..... 232/30, 31, 32, 232/43.2; 383/100; 220/495.05, 495.06; 24/400

(56) References Cited

U.S. PATENT DOCUMENTS

| | | | | | |
|---|---|---|---|---|---|
| 378,955 | A | * | 3/1888 | Dubey | 232/30 |
| 2,421,221 | A | * | 5/1947 | Rothe | 232/30 |
| 2,468,897 | A | * | 5/1949 | Rothe | 383/22 |
| 4,363,438 | A | * | 12/1982 | Connor | 232/30 |
| 4,802,773 | A | | 2/1989 | Gross | |
| 4,890,935 | A | * | 1/1990 | Ausnit et al. | 383/59 |
| 5,020,194 | A | * | 6/1991 | Herrington et al. | 24/400 |
| 5,199,795 | A | | 4/1993 | Russo et al. | |
| 5,246,114 | A | * | 9/1993 | Underwood | 206/524.8 |
| 5,279,421 | A | | 1/1994 | Gouge et al. | |
| 5,346,089 | A | | 9/1994 | Brown et al. | |
| 5,540,500 | A | * | 7/1996 | Tanaka | 383/43 |
| 5,645,353 | A | | 7/1997 | Linnell et al. | |
| 5,804,265 | A | * | 9/1998 | Saad et al. | 428/35.2 |
| 5,915,618 | A | | 6/1999 | Gaudet | |
| 6,045,264 | A | * | 4/2000 | Miniea | 383/41 |
| 6,085,906 | A | * | 7/2000 | Lambert | 206/524.8 |
| 6,123,257 | A | | 9/2000 | Guidicy | |
| 6,367,294 | B1 | | 4/2002 | Pauley | |
| 2003/0106929 | A1 | * | 6/2003 | Day et al. | 232/30 |
| 2004/0027036 | A1 | * | 2/2004 | Hall | 312/1 |

FOREIGN PATENT DOCUMENTS

| | | | |
|---|---|---|---|
| DE | 101 53 420 | * | 6/2002 |
| WO | WO 03/039772 | * | 5/2003 |

* cited by examiner

*Primary Examiner*—William L. Miller
(74) *Attorney, Agent, or Firm*—Lewis & Roca LLP

(57) ABSTRACT

A decontamination bag is positioned in the interior space of a public mailbox. The decontamination bag receives mail that is deposited in the mailbox. A postal worker, upon retrieving mail from the mailbox, closes the decontamination bag. The decontamination bag is equipped with an exit valve and an intake valve. Air from the interior of the bag may be sampled for contaminants that may be carried by letters or mailpieces through an exit valve. A decontaminating agent may be introduced to the interior of the decontamination bag through the intake valve. The contents of the decontamination bag are thereby purified within the bag. After decontamination, the contents of the decontamination bag may be purged and fresh air may be reintroduced into the bag. The decontamination bag may then be opened in order to retrieve its contents.

2 Claims, 5 Drawing Sheets

HANDLING POTENTIALLY CONTAMINATED MAIL

CROSS-REFERENCE TO RELATED APPLICATIONS

This application claims priority from U.S. Provisional Application No. 60/337,014 filed on Nov. 8, 2001, entitled "Handling Potentially Contaminated Collection Mails." The contents of the above provisional application is relied upon and expressly incorporated by reference as if fully set forth herein.

STATEMENT REGARDING FEDERALLY SPONSORED RESEARCH OR DEVELOPMENT

The invention was made by an agency of the United States government or under a contract with an agency of the United States government, the United States Postal Service ("USPS" or "Postal Service"), an independent establishment of the executive branch of the U.S. government.

BACKGROUND OF THE INVENTION

1. Field of the Invention

The present invention relates to methods for depositing and retrieving mail into and from a mailing receptacle. More particularly, the present invention relates to equipment and procedures associated with the mailing process whereby handling mail is done in a secure method in order to guard against potential biohazards in contaminated mail.

2. Description of the Related Art

The United States Postal Service provides mail collection boxes in a multitude of public locations where members of the public may deposit mail items. Indeed this is true throughout the world; national postal authorities make public mailing receptacles open to the public. One of the chief design criteria for the public mailbox has been easy access and usability by the public.

Mail is also deposited and collected in numerous other facilities beyond the traditional mailbox. Mailing locations and facilities include building mail chutes and mail receptacles found in building lobbies, delivery company lobbies, pack and send lobbies, and also post office lobbies.

In addition, the postal carriers and individuals who access mail facilities and depositories typically do so in a hurried manner with little if any thought to potential hazards that may wait inside them. Thus the public mailbox makes an inviting target for those bent on anonymous and antisocial behavior.

Mail receptacles have occasionally been the targets of pranks and vandalism. Recently there was a spate of more serious incidents involving contaminated mail. It is believed that mail was deposited and delivered through typical mail channels where the mailpieces had been deliberately contaminated with biological hazard material. Investigation has confirmed that some mailpieces deposited in mailboxes were contaminated with anthrax spores. Some members of the postal service, as a result of their handling contaminated mail, suffered exposure to the biological materials.

It is known that biological threats could be introduced in the collection mailboxes or other receptacles for items being placed in the hands of a delivery company for delivery to some other entity. Such threats could also be introduced via the mail chutes located in office building lobbies. Presently there are no preventing mechanisms for the delivery companies or the Postal Service to use to protect employees who collect and process the items for delivery and/or to protect the addressees or other recipients of the delivery items. There are no present methods available for someone handling the mail and other delivery items to identify and to protect against the threat.

In response to the threat posed by these incidents, procedures have been developed to treat mail that is believed to be contaminated with biohazard or infectious materials. Decontamination methods have been developed that will render contaminated mail safe or harmless. Decontamination technologies may rely on some form of irradiation to kill the biological materials such as microbes after mail has been collected and handled by employees. Other ideas involve using a form of chamber gas treatment for collection mail volumes and other delivery items in volume. These approaches will ultimately kill the microbes. To provided the initial protection to the carrier retrieving the collection mail, ideas include the use of liners within collection mail boxes and other receptacles for delivery items as mailbags to protect the individual handling the delivery items from physically touching them. However, application of these decontamination methods typically requires that suspected mail be transported from a collection location to a decontamination site. Thus, even with present decontamination procedures, there exists a risk of exposure to harmful agents within the mail while the mail is in transport to the decontamination site. Thus, there is a need to develop equipment and methods to minimize the chance of infection or exposure to biohazard material in the mail during the period between mail collection and decontamination.

The present mailbox design provides little protection against the threat posed from biohazards in contaminated mail. Accordingly, there is a need to improve the mailbox design. In addition, there is a need to develop practices and methods whereby letter carriers may perform their duties in a safe and secure manner.

It would be desirable to provide a means whereby contaminated mail in a mailbox can be collected with minimal risk of human exposure to infectious material potentially found in the mail.

It would also be desirable to retrofit the existing mailbox design such that mailboxes need not be replaced in their entirety. It would be advantageous to provide a means for secure handling of mail that can be applied to the mailbox design that is now in use.

It would also be desirable to provide a method to improve security in postal collection that can be enacted quickly and easily.

It would also be desirable to develop a collection mailbag of high quality that allows decontamination procedures to take place within the mailbag itself.

SUMMARY OF THE INVENTION

The present invention overcomes deficiencies in mailbox design by providing a means to contain the contents of a mailbox in a biohazard isolating receptacle. The containment allows the contents of a mailbox to be collected and transported with minimized exposure of mailpieces with the surrounding air environment. The secure handling can further be applied to mailboxes as presently designed and in use in the field. The secure handing technique is further simple in concept and design and can be quickly applied and retrofitted to present equipment.

Accordingly it is an object of the present invention in one aspect to provide a biohazard-isolating bag that is positioned in the mailbox.

It is a further object of the present invention to provide a means whereby a biohazard-isolating bag may be securely closed. The closure isolates the contents of the bag from the environment. In this manner any potential contamination in a mailpiece is confined to the interior of the bag. Potential exposure of the contamination to the public is minimized.

An additional object of the present invention is to provide a method of attaching a biohazard-isolating bag to the interior of a mailbox. The attachment method allows the present mailbox design to remain essentially unchanged so that conventional and customary methods of depositing and collecting mail are not affected.

According to the invention, it is suggested to use resealable bags (liners) in receptacles for collecting or depositing items for delivery to another. These receptacles would include collection boxes and chutes in office building lobbies, delivery company lobbies, in pack and send lobbies, or in post office lobbies. When the delivery items are to be collected from the receptacle, the bag is hermetically sealed by the mechanical opening action of the receptacle. The delivery person or letter carrier removes and locks the sealed collection bag and re-installs and empties bag and the collection point.

The collection bag or container is designed with a valve or valves permitting exit and entry of air or airborne particles. The valve or valves would have filters capable of trapping exiting airborne particles. The valve or valves can be used with a vacuum to remove air from within the bag while trapping airborne particles including any microbes within the filter. The valve or valves can also have an intake or intake/release feature. The purpose of the intake feature is to allow the collection bag to be inflated. The release feature is used to relax the vacuum.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed. Thus, the present invention comprises a combination of features, steps, and advantages which enable it to overcome various deficiencies of the prior art. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of a preferred embodiment of the present invention, reference will now be made to the accompanying drawings, which form a part of the specification, and wherein.

DETAILED DESCRIPTION OF THE PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

Figure 1:
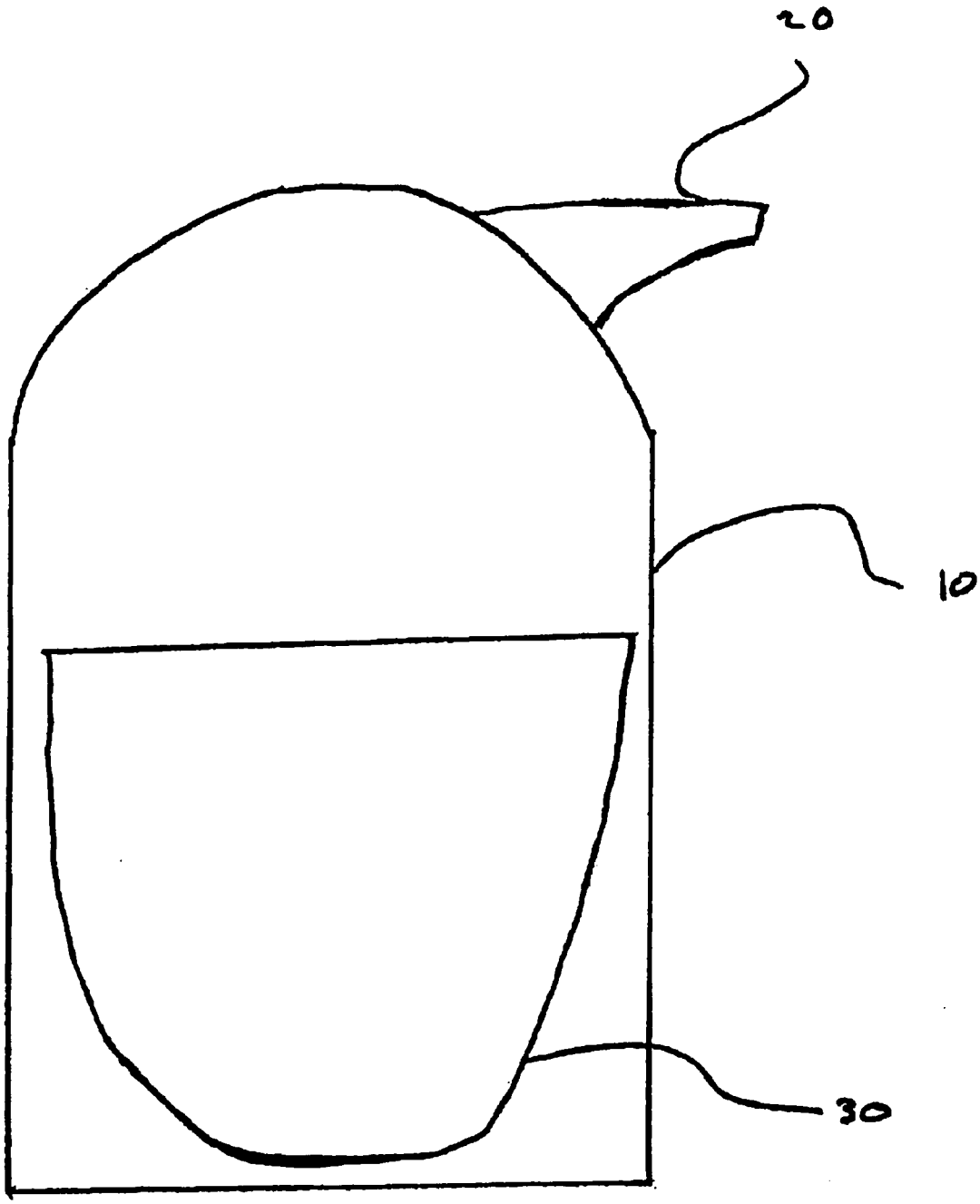
FIG. 1 is a side view of a postal mailbox with a biohazard liner in place where the outer wall of the mailbox is removed to show its interior.

Referring to FIG. 1 there is shown a schematic view of a biohazard isolating bag positioned inside a postal mailbox. Mailbox 10 is a conventional postal mailbox. Such a mailbox is typically rectangular in vertical profile and square or rectangular in horizontal profile although other configurations are possible. Mailbox 10 includes deposit door 20. Mailbox 10 also includes an access door, not shown, through which a postal worker accesses the contents of mailbox 10. As is customary, mailbox 10 defines an interior space and an exterior space. When rectangular in shape, mailbox 10 includes four walls a top and bottom.

Biohazard-isolating bag 30 (sometimes hereinafter referred to as "bag") is positioned in the interior of mailbox 10. Biohazard isolating bag 30 is preferably made of flexible plastic. Preferable plastic materials include polyvinyl chloride (PVC), polyethylene, polypropylene, and copolymers of polyethylene and polypropylene. The thickness of bag 30 is sufficient for multiple purposes. In a first aspect, the bag thickness must be sufficient to provide mechanical strength and integrity required for the bag's purposes. Additionally, the bag must be of sufficient thickness in order to provide a suitable barrier to isolate the interior contents of bag 30 from the exterior environment.

Biohazard-isolating bag 30 may also be used as a liner fitting inside of another, exterior bag. Thus, for example, a biohazard-isolating bag may be used in conjunction with traditional canvas or cloth mailbags. When used in such an arrangement, biohazard-isolating bag 30 is placed in the interior of another mailbag. Together bag 30 and the mailbag may be positioned inside mailbox 10.

The shape of bag 30 may assume different sizes and shapes. Generally bag 30 conforms to the interior shape of mailbox 10. Thus bag 30 may also take on different sizes and shapes depending on the size and dimensions of the mailbox. In a preferred embodiment the bag generally may assume the shape of an open rectangular box, corresponding to the interior shape of a standard postal mailbox. Bag 30 may also be semiovoid or elliptical in shape. In another embodiment the shape of bag is generally rounded with circular walls and a round bottom. The walls of bag 30 generally define an interior space and an exterior space. One end of bag 30 defines an opening, and the other side of bag 30 is closed.

In a preferred embodiment mailbox 10 and bag 30 include reciprocal attachment means by which to affix bag 30 to the interior of mailbox 10. In one embodiment rails 40 are located on inner surfaces of mailbox 10. Attachment rails 40 provide a means by which bag 30 may be secured to the interior of mailbox 10. Corresponding slides are positioned on bag proximate to bag opening.

Figure 2A:
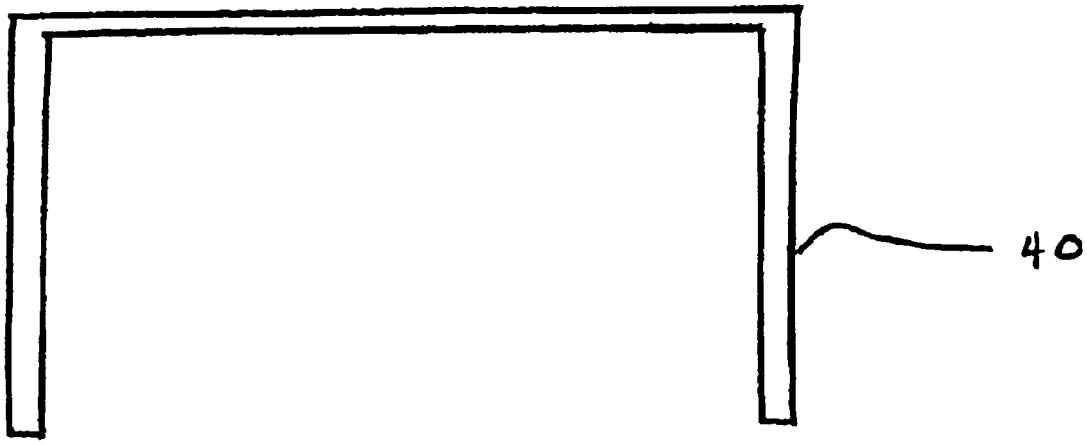
FIG. 2*a* is a top view of the rails used to affix a liner bag to the interior of a mailbox.

As shown in FIG. 2*a* rails may be attached to interior walls of mailbox 10. As shown in this figure rails are affixed to the front wall and two side walls of mailbox 10. No rail is attached to the rear wall of mailbox 10 as this wall also typically serves as the access door 20 to mailbox 10. While it is preferred to provide rails 40 on three walls of mailbox 10 other arrangements are possible. For example only two walls may include such rails 40. Further rails 40 preferably extend along a substantial length of each wall, although they need not do so. The purpose of rails 40 is to support bag 30, and the necessary support my be achieved in rails that only extend along a partial length of the wall.

Figure 2B:
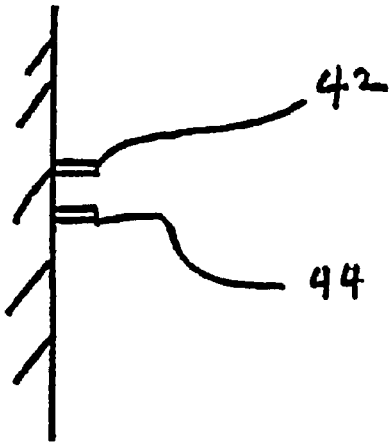
FIG. 2*b* is a side view of one embodiment of rails shown attached to a side wall of a mailbox.

FIG. 2*b* illustrates rails 40 as affixed to a mailbox wall in side view. Rail 40 comprises an upper lip 42 and lower lip 44. The space between upper lip 42 and lower lip 44 defines a groove. Support slides, not shown, engage rails 40 by fitting within the groove between upper lip 42 and lower lip 44. The slides are sturdy and rigid enough so as to provide a means by which to support the opening of bag 30 resting within rails 40. The slides may be attached to bag 30. The slides may, for example, fit within a pocket provided in bag 30 for receiving the slides. Alternatively, the slides may provide a friction fit such that bag 30 is held in place between rails 40 and corresponding slides by a pinching or friction effect. In practice the engagement between slides and rails 40 defines the opening shape of bag 30 when bag is positioned in place.

Rails 40 may be affixed to mailbox 10 using several known methods. Such methods include welding, bolting, gluing, and clamping. Also rails 40 may comprise any material such as metal, plastic, wood, or composite so long as it provides the necessary strength and rigidity to support bag 30, including when the bag is loaded with mail.

The rails are positioned at an interior position of the mailbox in order for the bag to hang in a desired location. In a preferred embodiment the preferred location of the bag is such that the bag opening is proximate the mailbox opening. In this manner the volume of the bag tends to approximate the corresponding volume of the mailbox.

Another preferred embodiment includes velcro as a support means. In this embodiment strips of velcro are affixed to interior walls of mailbox 30 where, for example, rails 40 have been described as being positioned. Reciprocal strips of velcro are attached to bag 30, proximate bag opening. Bag 30 is thus positioned in the desired position in the interior of mailbox 10 by contacting or engaging strips of velcro on bag 30 to corresponding strips of velcro on mailbox 10.

The attachment means provides a level of contact between the bag and the interior walls of the mailbox. The contact is such that when a mailpiece is deposited in mailbox 10 through deposit door 20, the mailpiece will tend to fall toward the interior space of bag 30. Generally a mailpiece will not fall outside the bag by passing between the bag and the interior wall of the mailbox. In this manner a mailpiece carrying a contaminant will fall into bag 30 where it can be isolated.

Other options may be used to position bag 30 in mailbox 10. Bag 30 may be hung from hooks or clamps positioned on the interior walls of mailbox 10. Additionally, bag 30 may be supported on a self-standing support framework that is not itself physically attached to mailbox 10. Thus a support frame may provide an attachment means such as rails, hooks, velcro, or some other supporting method. The support frame rests in mailbox 10, but is not affixed to the mailbox. Bag 30 is then positioned in the interior of mailbox 10 by affixing it or the attachment means provided on the support frame. The self-standing frame described in this paragraph may be an attractive method to deploy the biohazard-isolating bag 30 of this invention for one reason. A self-contained support may be installed with no need to retrofit anything to the mailbox structure itself. However, the self-standing attachment frame is for another reason less attractive than a means that is physically attached to mailbox 10. A self-standing support frame does not provide as close a contact between bag 30 and walls of mailbox 10 as does the attachment means that is physically part of mailbox 10.

Figure 3:
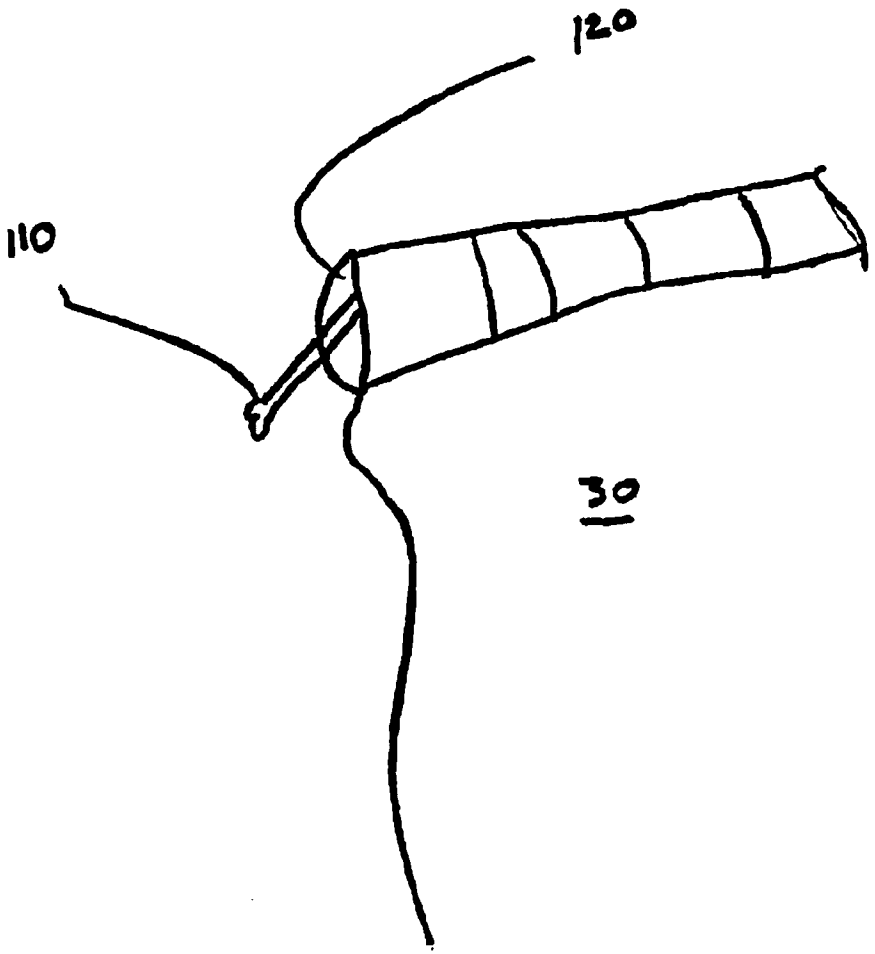
FIG. 3 is a perspective view of a mailbag with a drawstring for closing the mailbag.

In a preferred embodiment bag 30 includes closure means. Referring to FIG. 3 closure means may comprise a drawstring 110 and raceway 120 that encircle bag 30. Drawstring 110 may comprise any kind of elastic and flexible material such as cotton, fabric (synthetic and natural) blends, polymers, and metals. Raceway 120 comprises a channel or passage through which drawstring 110 passes. Raceway 120 may be formed of the same material as bag 30. Alternatively, raceway 110 may be formed of material different from that of bag 30 such as a fabric material. Raceway 120 should provide sufficient clearance so that drawstring 110 can move freely within raceway 120. Drawstring 110 may be drawn tight so that it tightly closes the opening of bag 30.

Preferably drawstring 110 and raceway 120 are positioned near the top of bag 30 as shown in FIG. 1. In such a position drawstring 110 and raceway 120 encircle the opening of bag 30. Placement of drawstring 110 and raceway 120 in such a position allows maximum use of the space in bag 30 to receive and carry mail.

In an alternate preferred embodiment bag closure means comprises a mechanical zipper. Said zipper may be of plastic or metallic composition.

Figure 4:
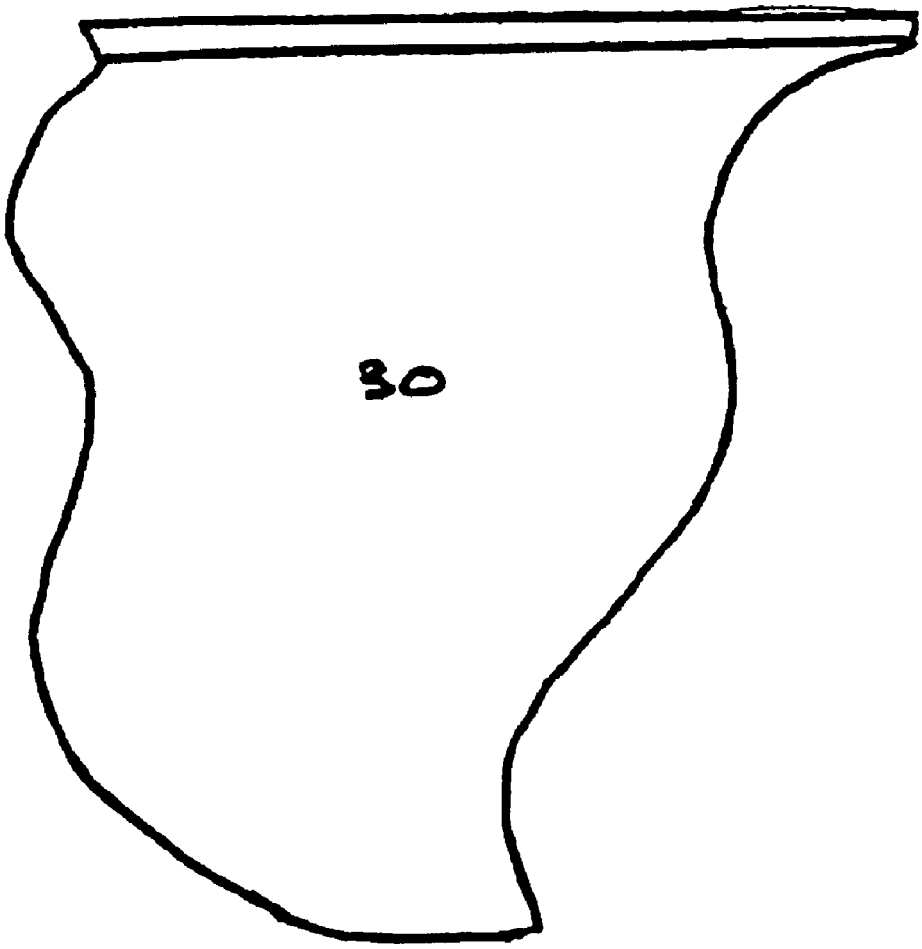
FIG. 4 is a perspective view of a mailbag showing a ziplock means to close the mailbag.

In another preferred embodiment the opening of bag 30 comprises a plasticized ziplock closure. FIG. 4 shows biohazard-isolating bag 30 when closed by means of an interlocking engagement, or ziplock, closure. The ziplock closure is known in the art as a method by which to provide a seal between plasticized sheets. The ziplock closure comprises interlocking ridges on opposing sheet faces. Pressing the opposing faces together forces the ridges to engage in interlocking fashion. The ziplock closure may be preferred in some applications for the high quality of its seal compared to other methods of closure. The ziplock closure may provide a substantially airtight seal. In practice a bag 30 with a ziplock closure is positioned in a mailbox as described above. Bag 30 has interlocking ridges that provide a ziplock closure positioned proximate the opening of bag. When removing bag 30, a postal employee presses opposing faces of bag 30 so as to interlock the engaging ridges. In this manner the contents of bag 30 are isolated from the external environment.

The seal effected by the closure means provides a substantial level of isolation of the contents of bag 30 from the outside environment. Different closure means may provide different levels of isolation. Thus, for example, a ziplock closure may provide a nearly airtight seal between the interior of bag 30 and the exterior. A drawstring closure, by contrast, in the closed position will not necessarily provide a completely airtight seal. Nevertheless, both kinds of closures may be appropriate for use in the invention. The level of isolation provided by the biohazard isolating bag 30 need not rise to the level of isolation that is found in a medical or research environment dealing with infectious germs. Rather, the level of isolation provided by biohazard isolation bag 30 is a substantial level of isolation such that the degree of exposure of biohazard material to humans is reduced by isolating such contaminants in bag 30.

An alternative method for closing bag 30 may be used in conjunction with the 5 slide framework. A lid may be fashioned that matches the opening defined by the slide/rail engagement. The lid is positioned over the bag opening so as to provide a barrier between the interior of bag 30 and the exterior environment. When a postal employee opens the mailbox through the access door, the lid would be positioned. An additional closure of bag 30 is obtained by tightening the drawstring around the lid. The bag is thereupon removed.

The bag possesses sufficient mechanical strength to withstand the wear and tear associated with receiving mail. In a preferred embodiment a polyethylene bag is up to 50 mils thick. The bag retains its integrity when subjected to a load of mail. The bag withstands being removed and carried to a mail truck without tearing or ripping.

In operation a biohazard-isolating bag is positioned in the interior of a mailbox. The bag may be secured by affixing attachment means on the bag to the receiving means on the interior of the mailbox. During use mailpieces that are deposited into the mailbox will fall into the interior of bag. At time for pickup, a postal employee accesses the mailbox through access door. The postal employee detaches the attachment means thus freeing bag from mailbox. Bag is closed by shutting the closure means. The bag is then removed from the mailbox. If desired a fresh bag may be positioned in the mailbox.

A benefit can be achieved by limiting the jostling that a mailpiece receives while the mailpiece is exposed to the open environment. Where, for example, a mailpiece is contaminated with a microbial agent, the ability of the microbe to infect a human being is increased when the contaminant becomes airborne. Conversely, the danger presented by an infectious microbe is minimized so long as that contaminant remains on a solid surface and does not become airborne. In the former case, infection can occur by breathing, ingestion, or skin contact with the microbial agent. In the latter case, where the infectious microbe remains on a surface, human contact with that surface would be the means of transmission. A jostling or shaking of a contaminated mailpiece, while it is open to the air, may provide the energy for a microbe to pass from the contaminated surface of a mailpiece to the air environment. While it may be impractical to eliminate jostling of a mailpiece altogether, the mailpiece can be isolated from the environment such that if contamination were to become airborne it would at least remain confined within the isolating enclosure.

It is to be understood that the present invention may be used in conjunction with other methods to render contaminated mail safe for human contact. Other known methods, such as radiation exposure or chemical exposure may be needed to cleanse the mail from harmful microbial contamination. Thus in one aspect the present invention provides a means to safely deliver suspect mail from a public mailbox to a decontamination site. One such kind of bag that may be directly employed in decontamination procedures is a decontamination bag.

Figure 5:
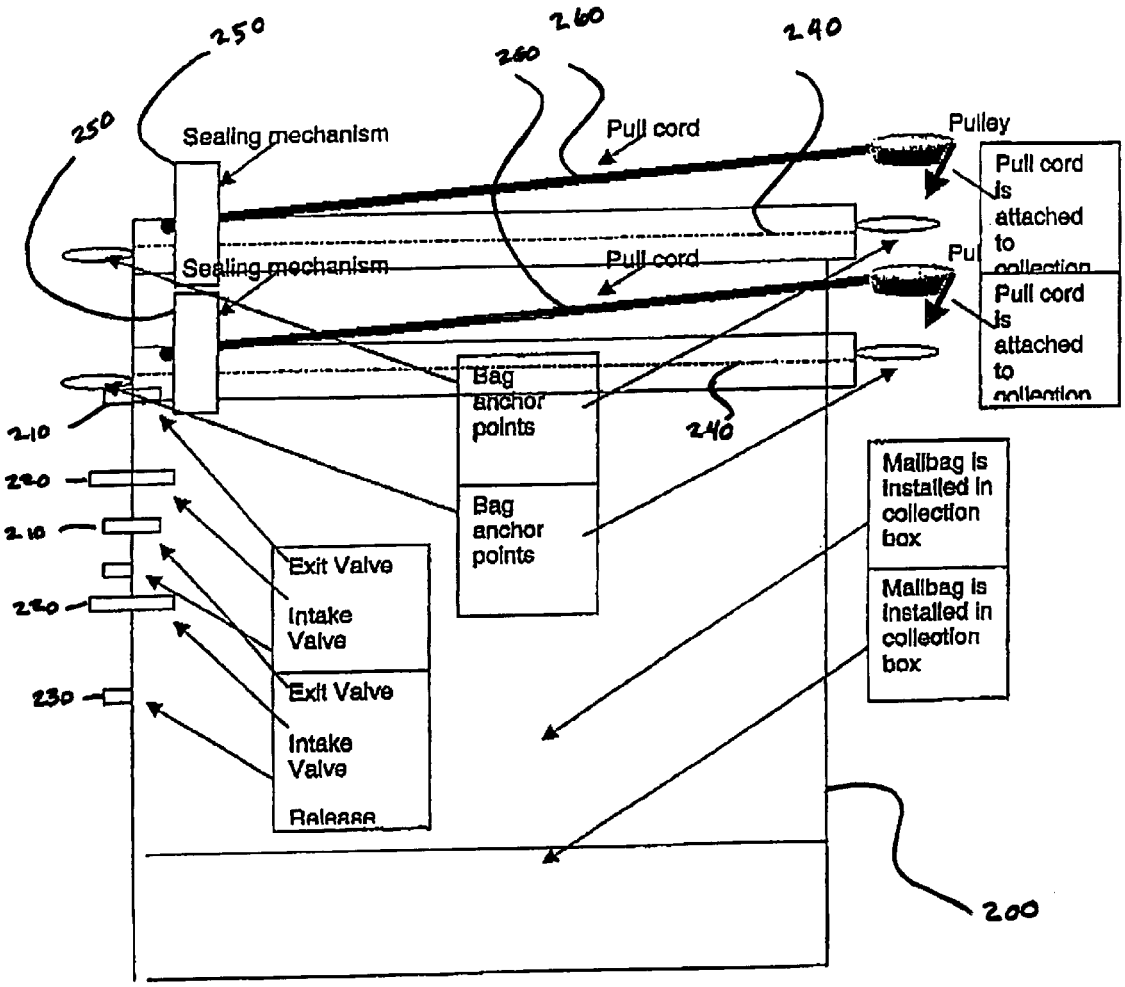
FIG. 5 is a side view of a particular kind of bag, a decontamination bag.

Referring now to FIG. 5, there is shown a preferred embodiment of the decontamination bag. A decontamination bag is different from the previously described biohazard-isolating bag in certain respects. A decontamination bag provides a highly isolating closure by which to provide a complete separation of the interior of the decontamination bag from the exterior of the bag.

Decontamination bag 200 is designed with two or more valves. One valve is exit valve 210. Exit valve 210 has a replaceable filter (not shown) that is capable of trapping exiting airborne particles greater than 4 microns. Exit valve 210 can be attached to a vacuum and its purpose is to allow the vacuum to remove air from within the bag while trapping airborne particles including any microbes within the filter. The second valve is intake valve 220. Intake valve 220 is an intake/release valve. The purpose of intake valve 220 is to allow the collection bag to be inflated. An additional valve, a release valve 230 is used to relax the vacuum.

An important feature of decontamination bag 200 is the quality of the seal it provides when closed. As shown in FIG. 5 it is preferred to provide a double sealing mechanism. This advantageously provides a redundant seal so as to effectively isolate contaminated materials in the bag from its exterior. The quality of the closure is such that biologicals in the interior are significantly isolated. The degree of isolation is such that decontamination procedures of the interior will effectively eliminate the hazard.

According to the invention, it is suggested to install reusable zip-lock type bags (liners) in collection boxes and at postal lobby chutes. At mail collection time the bag is hermetically sealed by the mechanical opening action of the receptacle in this instance a mailbox. The operator removes and locks the sealed collection bag and re-installs and empties the bag at the collection point.

The containers may be provided with mechanical fastening mechanisms for use in sealing the containers. One such mechanism is shown in FIG. 5 and is indicated by number 240 as comprising a common "zip-lock" type mechanism having an elongated bead which fits within and mates with an elongated groove formed in decontamination bag 200. As is known in the art the zip-lock may comprise a number of mutually engaging ridges. This mechanism may be provided in a strip of material secured to the bag. Although mechanical seals may provide the sole sealing for the containers, films of this type are also capable of accepting a heat seal. However, in this case, since there may not be an effective air-tight seal, particularly for maintaining an isolated atmosphere, it might be necessary or desirable to provide excess material at the ends of the container.

The method of producing an effective friction seal in a plastic container so as to isolate its contents has been described in earlier patents. These patents include U.S. Pat. Nos. 3,986,914; 5,199,795; 5,279,421; and 5,346,089.

In order to facilitate closing of the mechanical seal or friction seal 240 sealing clamps 250 may be attached to friction seal 240. Drawing sealing clamps 250 across friction seal 240 provides the needed pressure to engage the interlocking ridges on reciprocal mating surfaces. Pullcord 260, attached to sealing clamps 250, allows an operator to close decontamination bag 200 from some position remote from the bag itself. In a preferred embodiment at lease one pullcord of a decontamination bag positioned inside a mailbox will extend from the interior of a mailbox to its exterior. In this manner the operator, while positioned outside the mailbox, can pull on a pullcord and close the decontamination bag. Thus, once the mailbox is opened and the bag retrieved, there is minimal risk of exposure to a contaminant.

When the carrier has removed the collection mailbag (with contents) from the collection point a vacuum pump is attached to the exit valve and an air sample is withdrawn from the bag through the exit filter. The filter is removed and tested for the presence of microbes. If microbes are detected the corresponding bag is inflated (using the intake valve) with a disinfectant such as chlorine dioxide, potassium bromide or some other suitable agent. After an appropriate "kill period" the gas is oxidized and released. The contents of the bag may be removed and handled in the usual mail procedures. The bag may be treated as hazardous waste. If no microbes are detected in the air sampling then the release valve is used to relieve the vacuum, the contents of the bag are removed and the bag (and filter) are recycled into use again.

This system can also be set up to permit on-the-spot testing of the contents of the bag or other container, in particular, the air from the bag, to determine whether microbes are detected. Also, if they are detected, a disinfectant or the like can be put into the bag to "kill" or neutralize the microbes. After the appropriate "kill period" the disinfectant or gas can be neutralized and released. The contents of the bag or other container may be removed and handled in the usual procedures. The bag may be treated as hazardous waste.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. One of ordinary skill in the art will recognize that the process just described may easily have steps added, taken away, or modified without departing from the principles of the present invention. Accordingly, the scope of protection is not limited to the embodiments described herein, but is only limited by the claims which follow, the scope of which shall include all equivalents of the subject matter of the claims.

What is claimed is:

1. An assembly for receiving and handling mail so as to isolate biohazard material present on a mailpiece from the surrounding environment comprising:

a mail box defining a first interior space;

a deposit door on said mail box dimensioned to receive mail therethrough;

a decontamination bag defining a second interior space;

means for positioning said decontamination bag in said first interior space in an open configuration, so that mail items inserted through said deposit door will enter said second interior space;

means for closing the opening of said decontamination bag so as to isolate the contents of said decontamination bag from the surrounding environment; and at least one release valve positioned on said decontamination bag providing a closable fluid passage between said second interior space and an exterior of said decontamination bag.

2. An assembly for receiving and handling mail so as to isolate biohazard material present on a mailpiece from the surrounding environment comprising:

a mail box defining a first interior space;

a deposit door on said mail box dimensioned to receive mail therethrough;

a decontamination bag defining a second interior space;

means for positioning said decontamination bag in said first interior space in an open configuration, so that mail items inserted through said deposit door will enter said second interior space;

means for closing the opening of said decontamination bag so as to isolate the contents of said decontamination bag from the surrounding environment;

at least one exit valve positioned on said decontamination bag providing a closable fluid passage between said second interior space and an exterior of said decontamination bag; and at least one intake valve positioned on said decontamination bag providing a closable fluid passage between said second interior space and said exterior of said decontamination bag.

* * * * *